US012759819B2

(12) United States Patent
Tamura et al.

(10) Patent No.: US 12,759,819 B2
(45) Date of Patent: Oct. 13, 2026

(54) SHEET STORAGE DEVICE AND IMAGE FORMING APPARATUS

(71) Applicant: CANON KABUSHIKI KAISHA, Tokyo (JP)

(72) Inventors: Kouyou Tamura, Chiba (JP); Hajime Sekiguchi, Chiba (JP); Toshifumi Itabashi, Ibaraki (JP); Isao Kannari, Saitama (JP); Hiroshi Saito, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 122 days.

(21) Appl. No.: 18/765,454

(22) Filed: Jul. 8, 2024

(65) Prior Publication Data

US 2025/0051114 A1 Feb. 13, 2025

(30) Foreign Application Priority Data

Aug. 9, 2023 (JP) ..... 2023-129945

(51) Int. Cl.
*B65H 1/12* (2006.01)
*B65H 1/04* (2006.01)

(52) U.S. Cl.
CPC ..... *B65H 1/12* (2013.01); *B65H 1/04* (2013.01); *B65H 2801/06* (2013.01)

(58) Field of Classification Search
CPC ..... B65H 2405/112; B65H 2405/1122; B65H 2405/1124
See application file for complete search history.

(56) References Cited

U.S. PATENT DOCUMENTS 9,561,917 B2 * 2/2017 Morizono ..... B65H 1/14
2018/0346265 A1 * 12/2018 Niikura ..... B65H 3/128

FOREIGN PATENT DOCUMENTS

JP 2001213529 A 8/2001

* cited by examiner

*Primary Examiner* — Howard J Sanders
(74) *Attorney, Agent, or Firm* — ROSSI, KIMMS & McDOWELL LLP

(57) ABSTRACT

A sheet storage device includes a stacking member that lifts and lowers, a first regulating unit including a fixing member that is fixed to the stacking member and lifts and lowers together with the stacking member, a movable member that is arranged to be movable in a lifting and lowering direction of the fixing member with respect to the fixing member and is able to abut the end on the upstream side of the sheet, and a biasing member that applies a force to the movable member in a lifting direction of the fixing member, and a limiting portion configured to limit movement of the movable member in the lifting direction when the stacking member rotates in the lifting direction.

11 Claims, 8 Drawing Sheets

SHEET STORAGE DEVICE AND IMAGE FORMING APPARATUS

BACKGROUND OF THE INVENTION

Field of the Invention

The present invention relates to a sheet storage device that stores a sheet, and an image forming apparatus such as a copying machine, a printer, a facsimile machine, or a composite device having a plurality of these functions provided with the sheet storage device.

Description of the Related Art

Conventionally, a sheet feeding cassette, which is a sheet stacking unit capable of storing sheets of a plurality of different sizes, is generally used in a sheet storage device that stores the sheet. In such sheet feeding cassette, a sheet guide as a regulating member that can regulate a position of the sheet according to the size of the stored sheet and detect the size of the sheet is movably arranged. As such sheet guide, a side guide that regulates the sheet from both sides in a width direction orthogonal to a sheet feeding direction, and a rear end guide that regulates a position of a rear end in the sheet feeding direction from an upstream side in the sheet feeding direction are known.

Here, among the sheets stored in the sheet feeding cassette, there is a sheet of a type referred to as a tab sheet, a shape of which is not a simple rectangle. The tab sheet is a sheet in which a tab for entering a title is arranged on an end side of the sheet for the purpose of classifying a document. Positions of the tabs arranged on the tab sheet are not constant, and are displaced from each other so that the title entered on the tab can be easily checked. Therefore, in order to stably regulate the rear end in the feeding direction of the tab sheet, it is necessary to arrange a regulating surface over an entire area in the width direction of the sheet.

Japanese Patent Application Laid-Open No. 2001-213529 discloses a sheet storage device using an adapter for tab sheet for storing a tab sheet. The sheet storage device of Japanese Patent Application Laid-Open No. 2001-213529 includes a rotatable sheet stacking plate on which a sheet is stacked, and a spring that pushes up the sheet stacking plate. In the sheet storage device of Japanese Patent Application Laid-Open No. 2001-213529, by attaching an adapter in which a tab sheet rear end guide is arranged over a substantially entire area of an A4 size and letter size width to a sheet stacking member, the rear end can be regulated regardless of a position of a tab of an A4 size and letter size tab sheet. Therefore, the sheet storage device of Japanese Patent Application Laid-Open No. 2001-213529 can store a plurality of tab sheets with the rear ends aligned.

However, in Japanese Patent Application Laid-Open No. 2001-213529, only storage of the tab sheet of A4 size and letter size is considered, and there is a problem that storage of tab sheet of A5 size or smaller cannot be supported. For example, in a case of using an adapter obtained by simply moving a tab sheet rear end guide of an adapter for A4 size tab sheet to the rear end position of A5 size tab sheet, the number of stacked A5 size tab sheets is limited to about half of the number of stacked A4 size tab sheets.

Specifically, in a case where the A4 size tab sheet is set in the sheet stacking member to which the adapter is attached, when the sheet stacking member rotates to lift up, a rear end position of the A4 size tab sheet is close to the rotation center of the sheet stacking member, so that a movement amount in a height direction is small. Therefore, in this case, even in a case where the sheet stacking member is lifted up to the maximum height, the adapter does not project from an upper end of the sheet feeding cassette.

In contrast, in a case where the A5 size tab sheet is set in the sheet stacking member to which the adapter is attached, when the sheet stacking member rotates to lift up, the rear end position of the A5 size tab sheet is far from the rotation center, so that the movement amount in the height direction is large. Therefore, in this case, in a case where the sheet stacking member is lifted up to the maximum height, the adapter projects from the upper end of the sheet feeding cassette. In this regard, in order to prevent the adapter from projecting from the upper end of the sheet feeding cassette when this lifts up to the maximum height, it is necessary to limit the height of the adapter. Therefore, the number of A5 size tab sheets that can be stacked is reduced.

SUMMARY OF THE INVENTION

It is desirable to provide a sheet storage device capable of storing small size tab sheets without reducing the number of stackable tab sheets and an image forming apparatus.

A sheet storage device according to the present invention is a sheet storage device configured to store a sheet, the sheet storage device including a stacking member on which the sheet is stacked, the stacking member configured to lift and lower, and a first regulating unit that is arranged on the stacking member and configured to regulate a position of an end on the upstream side of the sheet, the first regulating member including a fixing member that is fixed to the stacking member and lifts and lowers together with the stacking member, a movable member that is arranged to be movable in a lifting and lowering direction of the fixing member with respect to the fixing member and is able to abut the end on the upstream side of the sheet, and a biasing member that applies a force to the movable member in a lifting direction of the fixing member, the sheet storage device including a limiting portion configured to limit movement of the movable member in the lifting direction when the stacking member rotates in the lifting direction.

Further features of the present invention will become apparent from the following description of exemplary embodiments with reference to the attached drawings.

DESCRIPTION OF THE EMBODIMENTS

Hereinafter, an embodiment will be described in detail with reference to the drawings.

<Configuration of Image Forming Apparatus>

Figure 1:
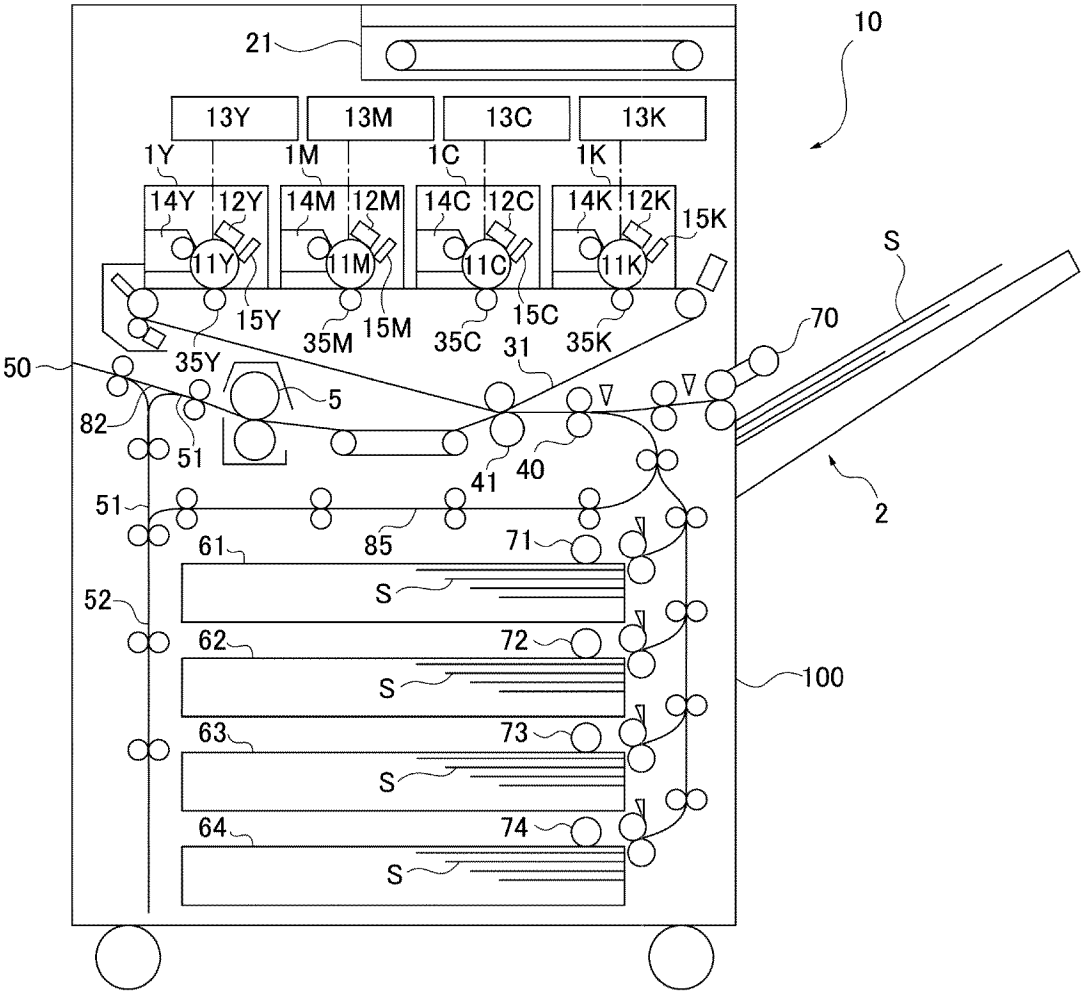
FIG. 1 is a schematic diagram of an image forming apparatus according to an embodiment of the present invention.

A configuration of an image forming apparatus 10 according to an embodiment of the present invention will be described in detail with reference to FIG. 1.

The image forming apparatus 10 includes image forming portions 1Y, 1M, 1C, and 1K, a manual sheet feeding door 2, a fixing device 5, scanners 13Y, 13M, 13C, and 13K, a reader 21, and an intermediate transfer member 31. The image forming apparatus 10 includes primary transfer portions 35Y, 35M, 35C, and 35K, a pair of registration rollers 40, a secondary transfer portion 41, a discharge port 50, and a switching portion 51. The image forming apparatus 10 further includes a sheet storage device 61, a sheet storage device 62, a sheet storage device 63, a sheet storage device 64, a sheet feeding roller 70, a sheet feeding roller 71, a sheet feeding roller 72, a sheet feeding roller 73, and a sheet feeding roller 74.

The image forming portions 1Y, 1M, 1C, and 1K are arranged below the reader 21 of an apparatus main body 100 of the image forming apparatus 10, and form images based on image information input from the scanners 13Y, 13M, 13C, and 13K, respectively. The image forming portions 1Y, 1M, 1C, and 1K include photosensitive drums 11Y, 11M, 11C, and 11K, chargers 12Y, 12M, 12C, and 12K, development devices 14Y, 14M, 14C, and 14K, and drum cleaning members 15Y, 15M, 15C, and 15K, respectively.

The photosensitive drums 11Y, 11M, 11C, and 11K are rotationally driven by a motor not illustrated.

The chargers 12Y, 12M, 12C, and 12K uniformly charge surfaces of the photosensitive drums 11Y, 11M, 11C, and 11K, respectively.

The development devices 14Y, 14M, 14C, and 14K supply toner to electrostatic latent images formed on the photosensitive drums 11Y, 11M, 11C, and 11K by the scanners 13Y, 13M, 13C, and 13K to form toner images on the photosensitive drums 11Y, 11M, 11C, and 11K, respectively.

The drum cleaning members 15Y, 15M, 15C, and 15K remove transfer residual toner remaining on the surfaces of the photosensitive drums 11Y, 11M, 11C, and 11K after transfer from the surfaces of the photosensitive drums 11Y, 11M, 11C, and 11K, respectively.

The manual sheet feeding door 2 is arranged to be openable and closable with respect to the apparatus main body 100, and serves as a manual feed tray of a manual type in which a sheet S can be manually set in an opened state.

The fixing device 5 applies heat and pressure to the toner image transferred to the sheet S conveyed by the secondary transfer portion 41 to fix the toner image on the sheet S. The fixing device 5 conveys the sheet S on which the toner image is fixed toward the discharge port 50.

The scanners 13Y, 13M, 13C, and 13K photoelectrically convert image information input from the reader 21. The scanners 13Y, 13M, 13C, and 13K form electrostatic latent images on the photosensitive drums 11Y, 11M, 11C, and 11K charged by the chargers 12Y, 12M, 12C, and 12K, respectively, based on the photoelectrically converted image information.

The reader 21 is arranged in an upper portion of the apparatus main body 100 and includes a scanning optical system for reading an image of an original. The reader 21 reads the image of the original by the scanning optical system and outputs the image information of the read image to the scanners 13Y, 13M, 13C, and 13K.

The intermediate transfer member 31 conveys the toner images transferred by the primary transfer portions 35Y, 35M, 35C, and 35K to the secondary transfer portion 41.

The primary transfer portions 35Y, 35M, 35C, and 35K transfer the toner images formed on the photosensitive drums 11Y, 11M, 11C, and 11K, respectively, to the intermediate transfer member 31.

The pair of registration rollers 40 conveys the sheet S fed by the sheet feeding roller 70, the sheet feeding roller 71, the sheet feeding roller 72, or the sheet feeding roller 73 to the secondary transfer portion 41 according to a conveyance timing of the toner image transferred to the intermediate transfer member 31.

The secondary transfer portion 41 transfers the toner image transferred to the intermediate transfer member 31 to the sheet S conveyed by the pair of registration rollers 40, and conveys the sheet S to which the toner image is transferred toward the fixing device 5.

The discharge port 50 discharges the sheet S conveyed by the fixing device 5 out of the apparatus main body 100.

In a case where a single-sided image forming mode is selected or in a case where a double-sided image forming mode is selected and the toner images are fixed on both sides of the sheet S, the switching portion 51 guides the sheet S conveyed by the fixing device 5 to the discharge port 50. In a case where the double-sided image forming mode is selected and the toner image is fixed only on one side of the sheet S, the switching portion 51 guides the sheet S conveyed by the fixing device 5 so as to be conveyed to the secondary transfer portion 41 via a reverse path 52 and a double-side path 85.

The sheet storage device 61, the sheet storage device 62, the sheet storage device 63, and the sheet storage device 64 are arranged below the apparatus main body 100 and store the sheet S. Each of the sheet storage device 61, the sheet storage device 62, the sheet storage device 63, and the sheet storage device 64 has a front-loading configuration of being arranged on a front side of the apparatus main body 100 so as to be able to be taken in and out of the apparatus main body 100. Here, the sheet S stored in the sheet storage device 61, the sheet storage device 62, the sheet storage device 63, and the sheet storage device 64 is a normal rectangular sheet or a tab sheet. Note that, the configuration of each of the sheet storage device 61, the sheet storage device 62, the sheet storage device 63, and the sheet storage device 64 will be described later in detail.

The sheet feeding roller 70 feeds the sheet S set on the manual feed tray configured by the manual sheet feeding door 2 in the opened state to the pair of registration rollers 40.

The sheet feeding roller 71 feeds the sheet S stored in the sheet storage device 61 to the pair of registration rollers 40.

The sheet feeding roller 72 feeds the sheet S stored in the sheet storage device 62 to the pair of registration rollers 40.

The sheet feeding roller 73 feeds the sheet S stored in the sheet storage device 63 to the pair of registration rollers 40.

The sheet feeding roller 74 feeds the sheet S stored in the sheet storage device 64 to the pair of registration rollers 40.

<Configuration of Sheet Storage Device>

Figure 2:
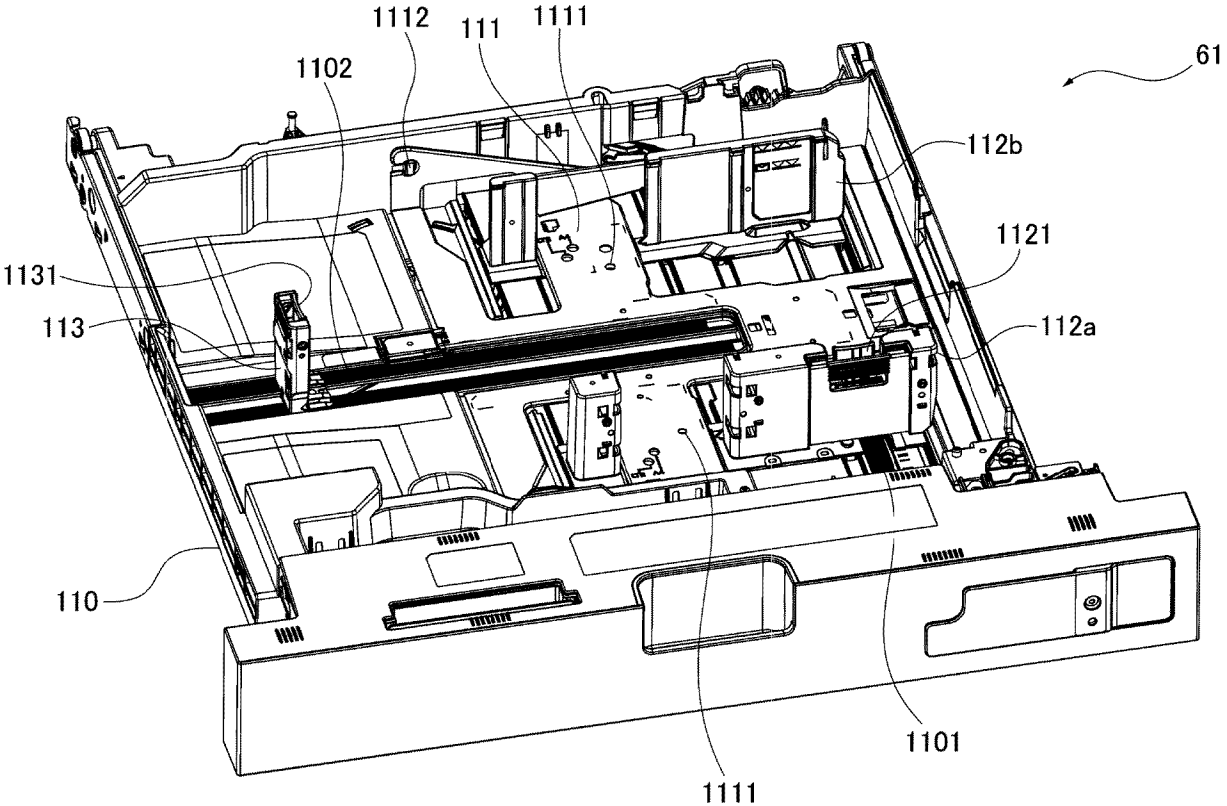
FIG. 2 is a perspective view of a sheet storage device according to the embodiment of the present invention in a state in which a tab sheet attachment unit is not attached.
Figure 3:
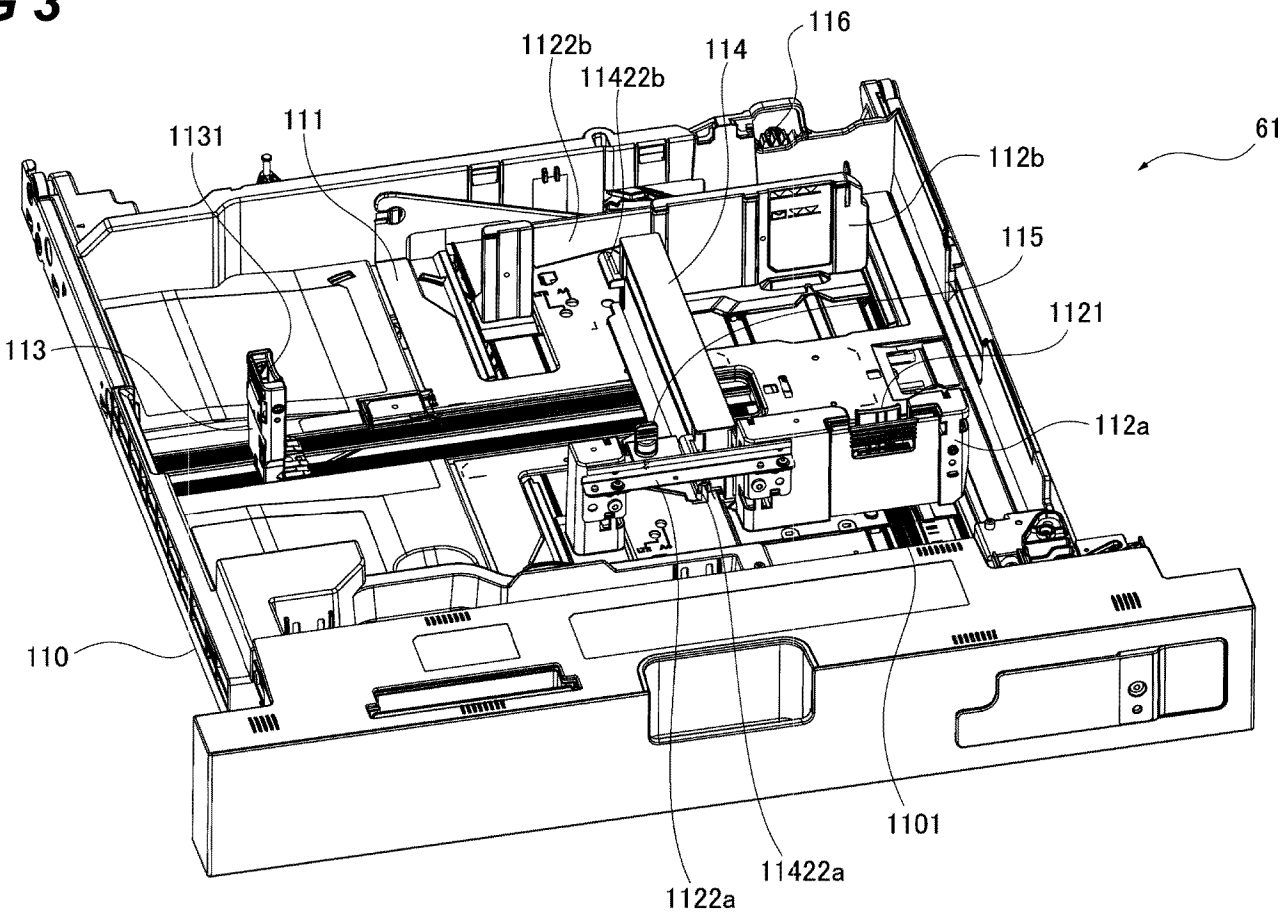
FIG. 3 is a perspective view of the sheet storage device according to the embodiment of the present invention in a state in which the tab sheet attachment unit is attached.

The configuration of each of the sheet storage device 61, the sheet storage device 62, the sheet storage device 63, and the sheet storage device 64 according to the embodiment of the present invention will be described in detail with reference to FIGS. 2 and 3. Note that, since all the configurations of the sheet storage device 61, the sheet storage device 62, the sheet storage device 63, and the sheet storage device 64 are the same, description and illustration of the configurations of the sheet storage device 62, the sheet storage device 63, and the sheet storage device 64 are omitted.

The sheet storage device 61 includes a sheet tray 110, a sheet stacking member 111, a side guide 112*a*, a side guide 112*b*, a rear end guide 113, and a tab sheet attachment unit 114. The sheet storage device 61 includes a thumbscrew 115, a lifter gear 116, a lifter plate 117, a locking portion 1101, a locking portion 1102, a release lever 1121, and a release lever 1131.

The sheet tray 110 stores the sheet S.

The sheet stacking member 111 as a stacking member supports the sheet S stored in the sheet tray 110. The sheet S is stacked on the sheet stacking member 111. The sheet stacking member 111 includes a hole 1111 for attaching the tab sheet attachment unit 114. The sheet stacking member 111 lifts and lowers in a lifting and lowering direction orthogonal to a feeding direction and a width direction orthogonal to the feeding direction by rotating about a rotation center 1112 on an upstream side in the feeding direction of the sheet S (hereinafter, simply referred to as a "feeding direction"). Here, the feeding direction is a direction on a side of the side guide 112*a* and the side guide 112*b* as seen from the rotation center 1112 in FIG. 2.

The side guide 112*a* as a second regulating member regulates a position of one end in the width direction. The side guide 112*a* is locked to the locking portion 1101 and is fixed to the sheet tray 110 so as to be movable in the width direction. The side guide 112*a* includes a hanging portion 1122*a* as a limiting portion that abuts a projection 11422*a* to be described later of the tab sheet attachment unit 114.

The side guide 112*b* as the second regulating member regulates a position of the other end in the width direction. The side guide 112*b* is locked to the locking portion 1101 and is fixed to the sheet tray 110 so as to be movable in the width direction. The side guide 112*b* includes a hanging portion 1122*b* as a limiting portion that abuts a projection 11422*b* to be described later of the tab sheet attachment unit 114.

The rear end guide 113 as a third regulating member is locked to the locking portion 1102 so as to be movable in the feeding direction so that the position in the feeding direction can be changed, and is supported by the sheet tray 110. The rear end guide 113 regulates a position on the upstream side in the feeding direction of the sheet S other than the tab sheet stored in the sheet tray 110. The rear end guide 113 is retracted on the upstream side in the feeding direction in a case where the sheet S stored in the sheet tray 110 is the tab sheet.

The tab sheet attachment unit 114 as a first regulating member is detachably attachable to the sheet stacking member 111. In a case where the sheet S stored in the sheet tray 110 is the tab sheet, the tab sheet attachment unit 114 is attached to the sheet stacking member 111 to regulate a position of an end on the upstream side in the feeding direction of the sheet S. A portion that can contact the end on the upstream side of the sheet S in the tab sheet attachment unit 114 is longer in the width direction than a portion that can contact the end on the upstream side of the sheet S in the rear end guide 113. Note that, the configuration of the tab sheet attachment unit 114 will be described later in detail.

The thumbscrew 115 fixes the tab sheet attachment unit 114 to the sheet stacking member 111.

The lifter gear 116 rotates by receiving a driving force from a driving source not illustrated arranged in the apparatus main body 100.

The lifter plate 117 moves with the rotation of the lifter gear 116 as the lifter gear 116 rotates.

The locking portion 1101 is arranged in the sheet tray 110. The locking portion 1101 locks the side guide 112*a* and the side guide 112*b* to the sheet tray 110.

The release lever 1121 is operated by a user. The release lever 1121 releases the locking between the locking portion 1101 and the side guide 112*a* and side guide 112*b* to enable the side guide 112*a* and side guide 112*b* to move in the width direction.

The locking portion 1102 is arranged in the sheet tray 110. The locking portion 1102 locks the rear end guide 113 to the sheet tray 110.

The release lever 1131 is operated by the user. The release lever 1131 releases the locking between the locking portion 1102 and the rear end guide 113 to enable the rear end guide 113 to move in the feeding direction or a direction opposite to the feeding direction.

The sheet storage device 61 having the above-described configuration is pulled out from the apparatus main body 100 when the sheet S is supplied by the user. After the sheet storage device 61 is pulled out from the apparatus main body 100, the side guide 112*a*, the side guide 112*b*, and the rear end guide 113 are positioned in predetermined positions according to a size of the sheet S, and the sheet S is set in the sheet tray 110. Then, the sheet storage device 61 is inserted into the apparatus main body 100 again.

<Configuration of Tab Sheet Attachment Unit>

Figure 4:
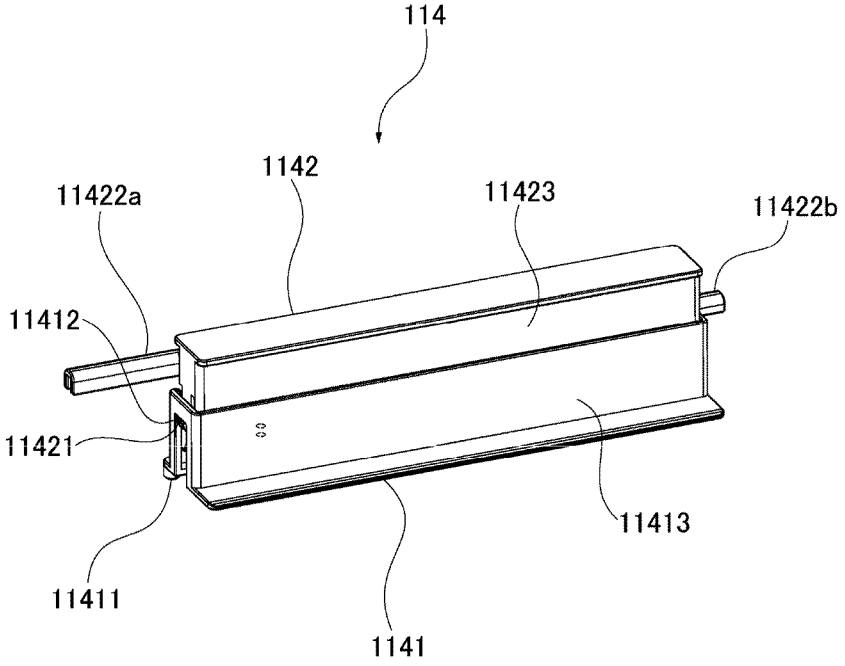
FIG. 4 is a perspective view of the tab sheet attachment unit of the sheet storage device according to the embodiment of the present invention.
Figure 5:
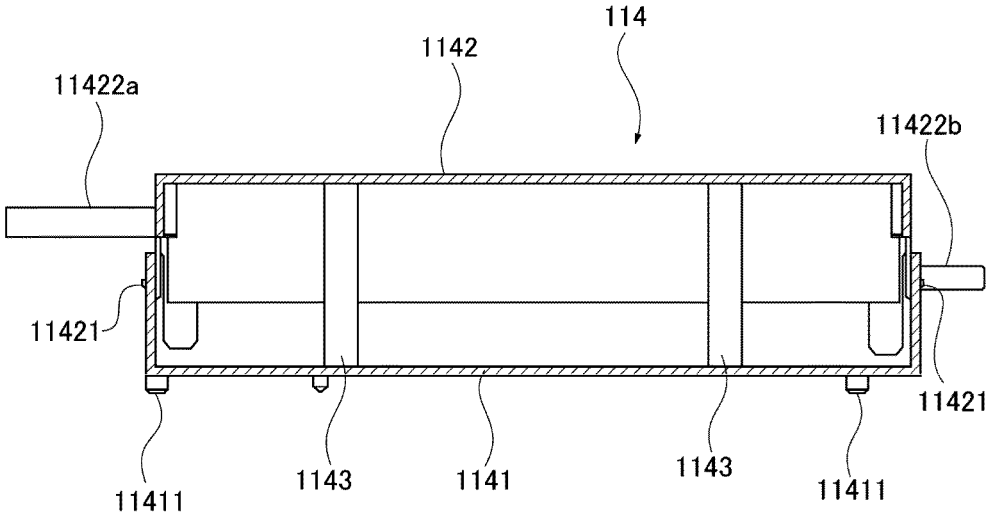
FIG. 5 is a cross-sectional view of the tab sheet attachment unit of the sheet storage device according to the embodiment of the present invention.

The configuration of the tab sheet attachment unit 114 of the sheet storage device 61 according to the embodiment of the present invention will be described in detail with reference to FIGS. 4 and 5.

The tab sheet attachment unit 114 includes a fixing member 1141, a movable member 1142, and a biasing spring 1143.

The fixing member 1141 is attached to the sheet stacking member 111 and can lift and lower together with the sheet stacking member 111. The fixing member 1141 includes a boss 11411, a retaining portion 11412, and a rear end regulating surface 11413.

The boss 11411 projects in an attachment direction of the tab sheet attachment unit 114 with respect to the sheet stacking member 111, and is inserted into the hole 1111 of the sheet stacking member 111.

The retaining portions 11412 are arranged on both ends in the width direction of the fixing member 1141. The retaining portion 11412 is engaged with a snap fit portion 11421 to be described later of the movable member 1142 so as to be relatively movable, and holds the movable member 1142 so that the movable member 1142 does not come off from the fixing member 1141.

The end on the upstream side in the feeding direction of the sheet S abuts the rear end regulating surface 11413. In a case where the sheet S is the tab sheet, the rear end regulating surface 11413 abuts a tab of the tab sheet.

The movable member 1142 is arranged to be movable with respect to the fixing member 1141. The movable member 1142 includes the snap fit portion 11421, a projection 11422*a*, a projection 11422*b*, and a rear end regulating surface 11423.

The snap fit portion 11421 is movably engaged with the retaining portion 11412 of the fixing member 1141 to allow the fixing member 1141 to hold the movable member 1142.

The projection 11422*a* projects laterally outward from one end in the width direction of the movable member 1142. When the movable member 1142 lifts, the projection 11422*a* abuts the hanging portion 1122*a* of the side guide 112*a* to limit the lifting of the movable member 1142.

The projection 11422*b* projects laterally outward from the other end in the width direction of the movable member 1142. When the movable member 1142 lifts, the projection 11422*b* abuts the hanging portion 1122*b* of the side guide 112*b* to limit the lifting of the movable member 1142.

The end on the upstream side in the feeding direction of the sheet S abuts the rear end regulating surface 11423. In a case where the sheet S is the tab sheet, the rear end regulating surface 11423 abuts the tab of the tab sheet.

The biasing spring 1143 as a biasing member is arranged between the fixing member 1141 and the movable member 1142. When the tab sheet attachment unit 114 is attached to the sheet stacking member 111, the biasing spring 1143 applies a force to the movable member 1142 in a lifting direction of the sheet stacking member 111.

The tab sheet attachment unit 114 having the above-described configuration is positioned with respect to the sheet stacking member 111 by inserting the positioning boss 11411 of the fixing member 1141 into the hole 1111 of the sheet stacking member 111. Then, the tab sheet attachment unit 114 is attached to be fixed to the sheet stacking member 111 by fastening the thumbscrew 115.

When the user sets the tab sheet on the sheet tray 110, the rear end regulating surface 11413 of the fixing member 1141 and the rear end regulating surface 11423 of the movable member abut the tab of the tab sheet to regulate the position of the tab sheet. Since the length in the width direction of the rear end regulating surface 11413 and the rear end regulating surface 11423 is equivalent to the length in the width direction of an A5 size sheet S unlike the rear end guide 113, the end on the upstream side in the feeding direction of an A5 size tab sheet can be stably regulated.

<Motion of Sheet Storage Device>

Figure 6:
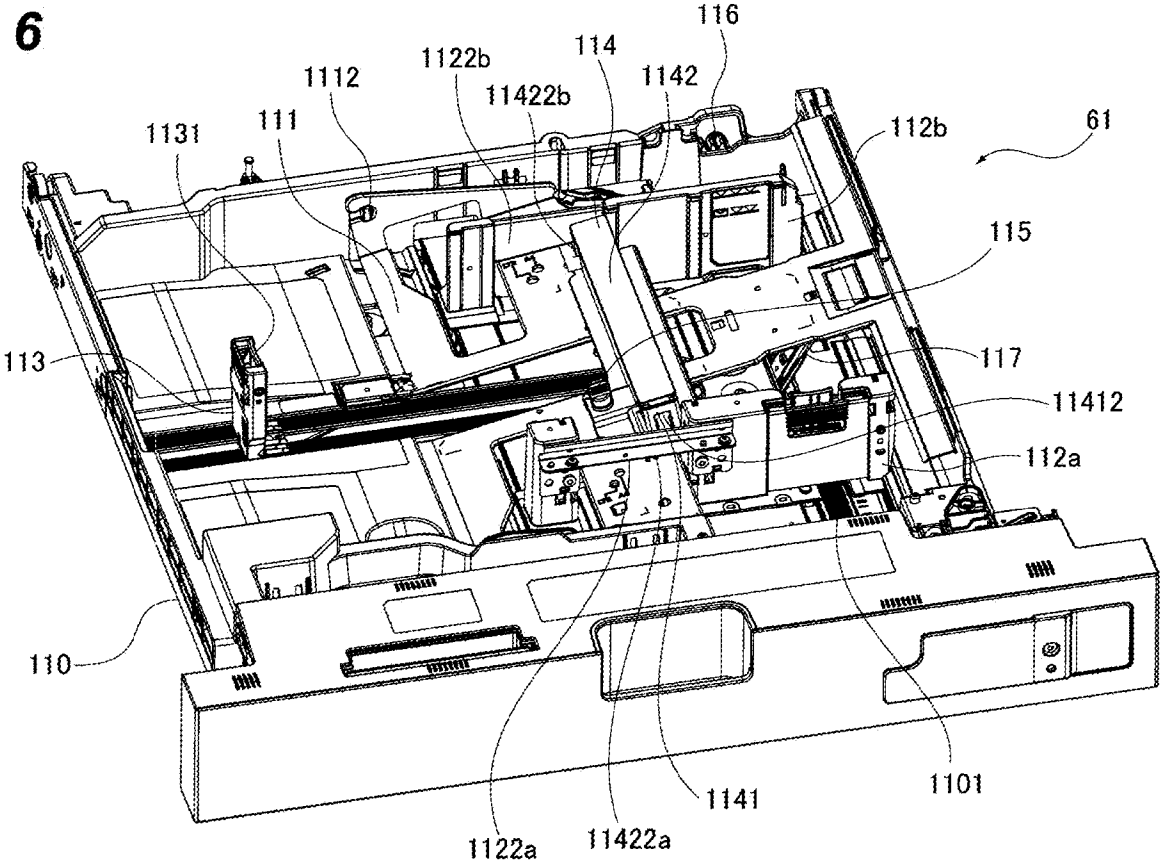
FIG. 6 is a perspective view of the sheet storage device according to the embodiment of the present invention in a state in which a sheet stacking member is lifted up.
Figure 7:
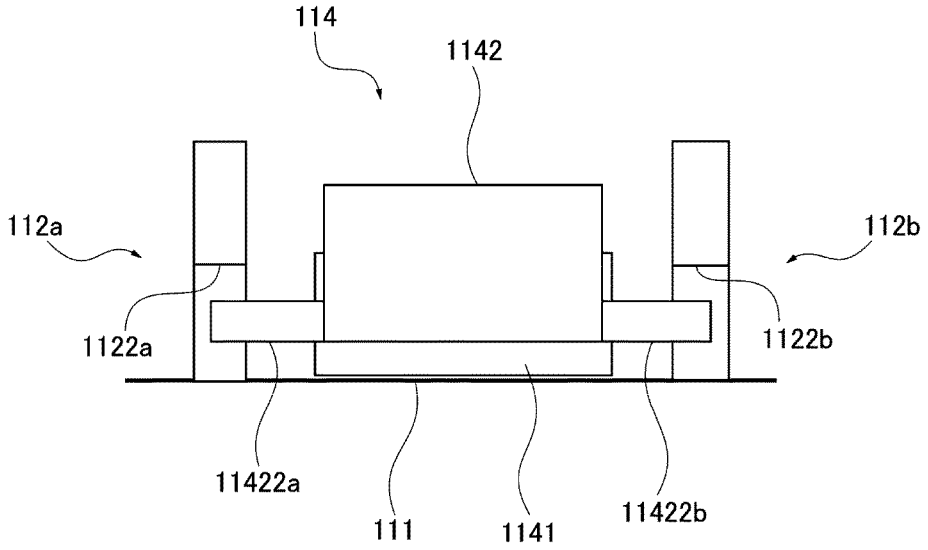
FIG. 7 is a schematic diagram illustrating a positional relationship between a side guide and a projection of a movable member in a state in which the sheet stacking member of the sheet storage device according to the embodiment of the present invention is not lifted up.
Figure 8:
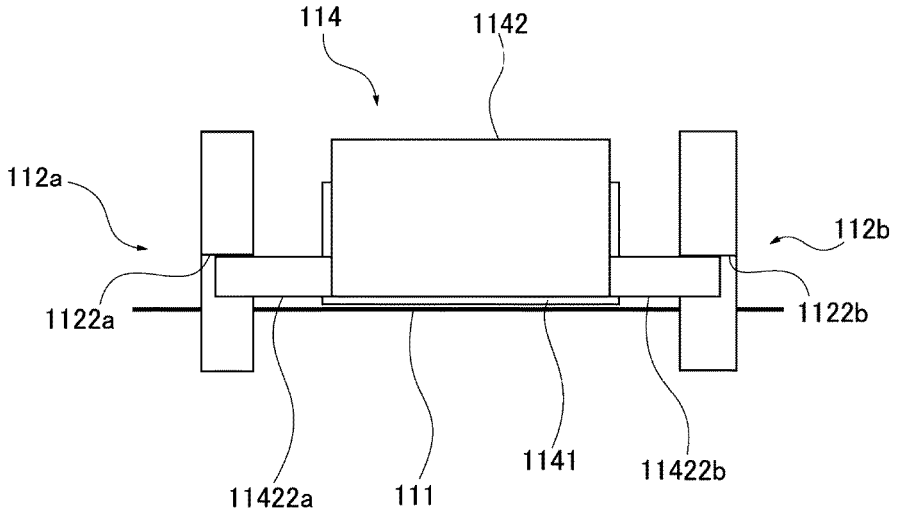
FIG. 8 is a schematic diagram illustrating a positional relationship between the side guide and the projection of the movable member in a state in which the sheet stacking member of the sheet storage device according to the embodiment of the present invention is lifted up.

A motion of each of the sheet storage device 61, the sheet storage device 62, the sheet storage device 63, and the sheet storage device 64 according to the embodiment of the present invention will be described in detail with reference to FIGS. 6 to 8. Note that, since all the motions of the sheet storage device 61, the sheet storage device 62, the sheet storage device 63, and the sheet storage device 64 are the same, description of the motions of the sheet storage device 62, the sheet storage device 63, and the sheet storage device 64 is omitted.

In a state in which the sheet stacking member 111 is not lifted up, the projection 11422*a* and the hanging portion 1122*a* of the side guide 112*a* are separated from each other, and the projection 11422*b* and the hanging portion 1122*b* of the side guide 112*b* are separated from each other.

When the lifter gear 116 and the lifter plate 117 are driven, the sheet stacking member 111 is lifted up by rotating about the rotation center 1112 to be lifted.

At that time, since the fixing member 1141 is fixed to the sheet stacking member 111, this lifts in conjunction with the lift-up of the sheet stacking member 111. In contrast, when the movable member 1142 lifts to some extent together with the fixing member 1141, this reaches an abutment position in which the projection 11422*a* abuts the hanging portion 1122*a* and the projection 11422*b* abuts the hanging portion 1122*b*, so that the lifting is limited.

Then, as the sheet stacking member 111 further lifts, the fixing member 1141 lifts while guiding the snap fit portion 11421 by the retaining portion 11412. By maintaining the state in which the projection 11422*a* abuts the hanging portion 1122*a* and the projection 11422*b* abuts the hanging portion 1122*b*, the lifting of the movable member 1142 from the abutment position is limited. The lifting of the movable member 1142 can be limited by a simple configuration in which the projection 11422*a* abuts the hanging portion 1122*a* and the projection 11422*b* abuts the hanging portion 1122*b*.

The projection 11422*a* and the projection 11422*b* are separated from the hanging portion 1122*a* and the hanging portion 1122*b*, respectively, when the sheet stacking member 111 lowers and the movable member 1142 lowers from the abutment position. As a result, the projection 11422*a* and the projection 11422*b* do not come into contact with the hanging portion 1122*a* and the hanging portion 1122*b*, respectively, when the side guide 112*a* and the side guide 112*b* are moved to supply the sheet S to the sheet tray 110. Therefore, the side guide 112*a* and the side guide 112*b* can be easily operated in a state in which the sheet stacking member 111 does not lift up.

In this manner, the tab sheet attachment unit 114 expands and contracts in the lifting and lowering direction of the sheet stacking member 111 as the sheet stacking member 111 lifts or lowers. As a result, it is possible to stack the tab sheets of a small size such as the A5 size of the number equivalent to that of the A4 size tab sheets in the tab sheet attachment unit 114.

In this embodiment, the tab sheet attachment unit 114 includes the fixing member 1141 that is fixed to the sheet stacking member 111, lifts and lowers together with the sheet stacking member 111, and can abut the end on the upstream side of the sheet S. The tab sheet attachment unit 114 includes the movable member 1142 that is arranged to be movable in the lifting and lowering direction of the fixing member 1141 with respect to the fixing member 1141 and can abut the end on the upstream side of the sheet S. The tab sheet attachment unit 114 further includes the biasing spring 1143 that applies a force to the movable member 1142 in the lifting direction of the fixing member 1141.

In this embodiment, the sheet storage device 61 includes the hanging portion 1122*a* and the hanging portion 1122*b* that limits the movement of the movable member 1142 in the lifting direction when the sheet stacking member 111 rotates in the lifting direction. As a result, it is possible to store the tab sheets of a small size without reducing the stackable number.

In this embodiment, by arranging the hanging portion 1122*a* on the side guide 112*a* and arranging the hanging portion 1122*b* on the side guide 112*b*, it is possible to regulate the position of the sheet S in the width direction and at the same time limit the lifting of the movable member 1142.

It goes without saying that the present invention is not limited to the above-described embodiment, and various modifications can be made without departing from the gist thereof.

Specifically, in the above-described embodiment, the lifting of the movable member 1142 is limited by the hanging portion 1122*a* of the side guide 112*a* and the hanging portion 1122*b* of the side guide 112*b*. However, there is no limitation, and the lifting of the movable member 1142 may be limited by a member other than the side guide 112*a* and the side guide 112*b* of the sheet storage device 61. For example, a main body of the sheet tray 110 may be provided with a portion that comes into contact with the movable member 1142 and limits the lifting of the movable member 1142. The apparatus main body 100 of the image forming apparatus 10 may be provided with a portion that comes into contact with the movable member 1142 and limits the lifting of the movable member 1142.

In the above-described embodiment, the projection 11422*a* abuts the hanging portion 1122*a* and the projection 11422*b* abuts the hanging portion 1122*b*, so that the lifting of the movable member 1142 is limited. However, there is no limitation, and the lifting of the movable member 1142 may be limited by any uneven shape arranged in the sheet storage device 61.

In the above-described embodiment, the tab sheet attachment unit 114 is detachably attached to the sheet stacking member 111, but there is no limitation, and the tab sheet attachment unit 114 may be fixed to the sheet stacking member 111 so as not to be detachable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-129945, filed Aug. 9, 2023, which is hereby incorporated by reference herein in its entirety.

What is claimed is:

1. A sheet storage device, comprising:

a sheet storage member configured to store a sheet;

a stacking member on which the sheet is stacked, the stacking member arranged on the sheet storage member and being configured to lift and lower; and a first regulating unit that is arranged on the stacking member and configured to regulate a position of an end on an upstream side of the sheet in a feeding direction of the sheet, the first regulating unit including:

a fixing member that is fixed to the stacking member and lifts and lowers together with the stacking member; a movable member that is arranged to be movable in a lifting and lowering direction of the fixing member with respect to the fixing member and is able to abut the end on the upstream side of the sheet; and a biasing member that applies a force to the movable member in a lifting direction of the fixing member, the sheet storage member including an abutting portion configured to abut to regulate movement of the movable member in the lifting direction when the stacking member lifts in the lifting direction.

2. The sheet storage device according to claim 1, wherein the movable member includes:

a projection that projects in a width direction orthogonal to the feeding direction and the lifting and lowering direction, and the abutting portion regulates the movement of the movable member in the lifting direction by abutting the projection.

3. The sheet storage device according to claim 2, wherein the abutting portion is separated from the projection when the stacking member lowers from an abutment position in which the abutting portion and the projection abut each other.

4. The sheet storage device according to claim 1, further comprising:

a second regulating unit configured to regulate a position in a width direction orthogonal to the feeding direction and the lifting and lowering direction of the sheet, wherein the abutting portion is arranged on the second regulating unit.

5. The sheet storage device according to claim 1, wherein a tab sheet as a sheet is stacked on the stacking member, and the first regulating unit regulates a position of an end on the upstream side of the tab sheet by abutting a tab of the tab sheet.

6. The sheet storage device according to claim 1, wherein the first regulating unit is detachably attached to the stacking member.

7. The sheet storage device according to claim 1, further comprising:

a third regulating unit configured to regulate the sheet by abutting the end on the upstream side of the sheet, wherein a portion that can come into contact with the end on the upstream side of the sheet in the first regulating unit is longer in a width direction orthogonal to the feeding direction and the lifting and lowering direction than a portion that can come into contact with the end on the upstream side of the sheet in the third regulating unit.

8. The sheet storage device according to claim 1, wherein the stacking member is configured to lift and lower by rotating about a rotation center arranged in an upstream side in the feeding direction of the sheet.

9. The sheet storage device according to claim 1, wherein the fixing member is able to abut the end on the upstream side of the sheet.

10. An image forming apparatus comprising:

the sheet storage device according to claim 1; and an image forming portion configured to form an image on the sheet stored in the sheet storage device.

11. The sheet storage device according to claim 1, wherein the abutting portion is configured to abut to the regulate movement of the movable member in the lifting direction when the stacking member lifts in the lifting direction such that as the stacking member is lifted from a first position, where the stacking member is not lifted, to a second position, where the stacking member is lifted, the abutting portion abuts to regulate the movement of the movable member in the lifting direction before the stacking member reaches the second position.

* * * * *